United States Patent [19]

Current

[11] 4,163,493

[45] Aug. 7, 1979

[54] NEEDLE STORAGE PACKAGE

[75] Inventor: Wayne A. Current, Holmdel, N.J.

[73] Assignee: The Singer Company, New York, N.Y.

[21] Appl. No.: 938,281

[22] Filed: Aug. 31, 1978

[51] Int. Cl.[2] ..... B65D 85/24

[52] U.S. Cl. ..... 206/380; 24/201 C; 24/230 BC

[58] Field of Search ..... 206/380, 443; 24/201 C, 24/207, 230 BC

[56] References Cited

U.S. PATENT DOCUMENTS

| | | | |
|---|---|---|---|
| 2,477,194 | 7/1949 | Willard | 206/380 |
| 2,577,120 | 12/1951 | Fienz | 24/201 C |
| 2,723,484 | 11/1955 | Nelson | 24/201 C |
| 3,227,265 | 1/1966 | Schneider | 206/382 |
| 3,372,442 | 3/1968 | Ishimatsu | 24/201 C |
| 3,979,801 | 9/1976 | Tarean | 24/230 BC |

FOREIGN PATENT DOCUMENTS

| | | | |
|---|---|---|---|
| 570468 | 9/1958 | Belgium | 206/380 |
| 1133307 | 11/1968 | United Kingdom | 206/380 |

*Primary Examiner*—Herbert F. Ross
*Attorney, Agent, or Firm*—Michael H. Wallach; Robert E. Smith; Edward L. Bell

[57] ABSTRACT

A storage package for sewing machine needles which may be attached to like packages to expand the needle storage capacity. The package is molded from a resilient material to permit the convenient attachment of additional packages at the sides or the front or back of each package.

4 Claims, 5 Drawing Figures

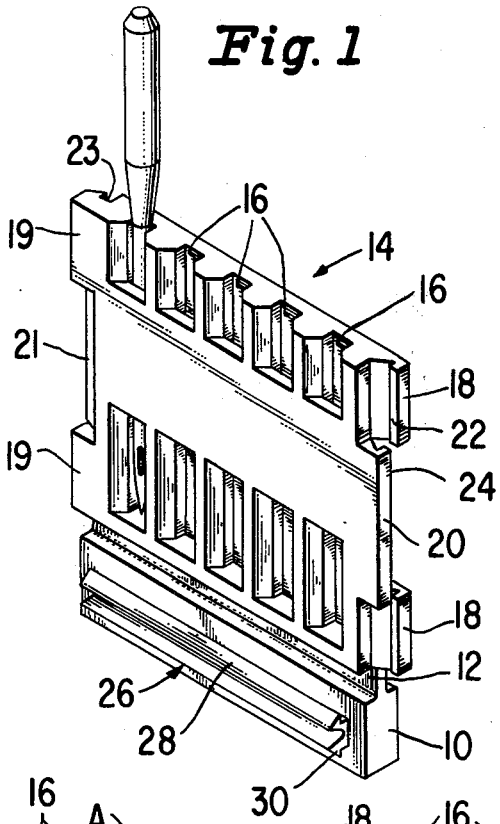
Fig. 1
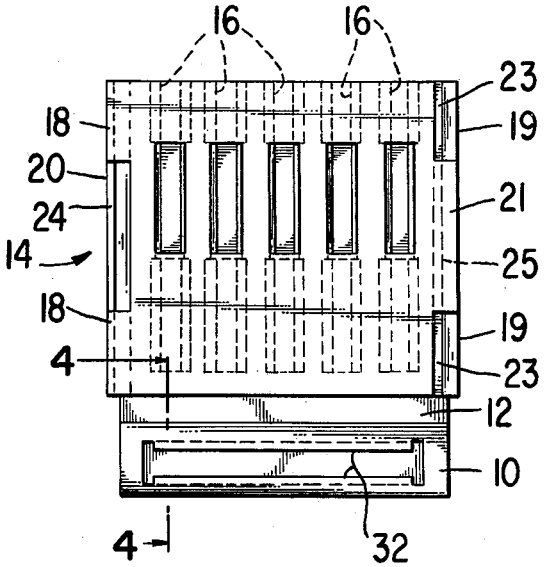
Fig. 3
Fig. 2
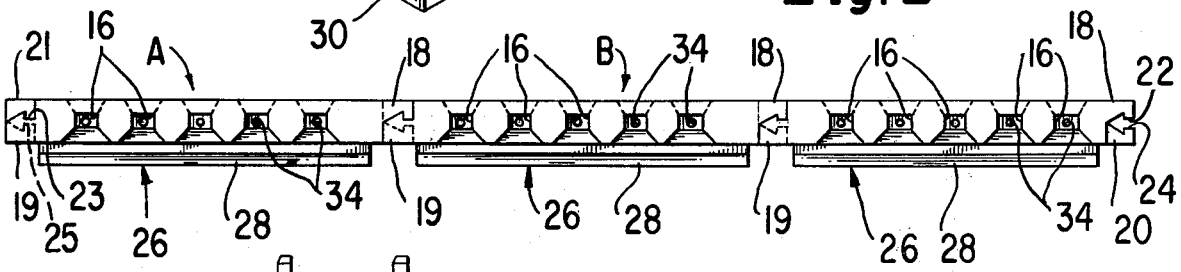
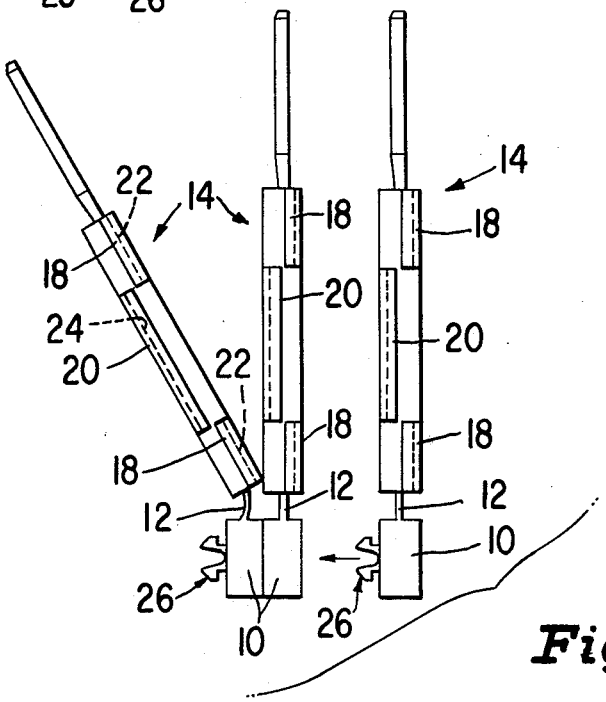
Fig. 5
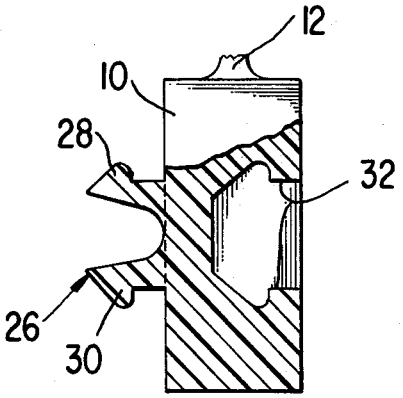
Fig. 4

NEEDLE STORAGE PACKAGE

BACKGROUND OF THE INVENTION

1. Field of the Invention

This invention relates to packages for the storage of sewing machine needles.

2. Description of the Prior Art

Those skilled in the art of sewing will appreciate that it is convenient to have a variety of different types of sewing needles available so that the proper needle may be chosen for use in sewing specific weights and types of fabric. It is also advantageous to have a set of spare needles available in the event that a needle breaks or is lost.

One problem with prior known needle packages is that they did not securely hold the needles after the packages were opened.

Another problem with some prior known needle packages is that they did not segregate the stored needles so that a specific needle could be conveniently retrieved.

Still another problem is that the storage capacity of the package could not be expanded as additional needles were purchased.

SUMMARY OF THE INVENTION

It is an object of this invention to provide a needle storage package which may be conveniently combined with similar packages to expand the needle storage capacity.

It is another object to produce a needle storage package that is easily molded in one piece.

Still another object is to produce a storage package in which the needles are retained in an upright position for easy identification and convenient accessibility.

The disclosed objects and other advantages are achieved by molding a storage package which has a plurality of discrete needle storage compartments, each of which frictionally receives and retains one needle, with the shank thereof remaining accessible above the top of the package. Package attachment means are molded onto the sides of the package to permit two or more packages to be joined together side by side to expand the storage capacity. The rear of each package has a socket molded into its base which may receive a bifurcated projection molded onto the front of the base on a like package. A plurality of packages may thereby be joined together to further expand the storage capacity. A flexible hinge is molded between the base and the storage compartments to permit packages which have been joined together to be bent away from each other, thereby increasing accessibility to the needles stored therein.

BRIEF DESCRIPTION OF THE DRAWINGS

The above and other objects of this invention will become evident from a full and complete understanding of the preferred embodiment which is hereinafter set forth in such detail as to enable those skilled in the art to readily understand the function, operation, construction and advantages of it when read in conjunction with the accompanying drawings in which:

FIG. 1 is a perspective view of a needle storage package molded in accordance with the teachings of the present invention;

FIG. 2 is a top plan view showing three needle storage packages joined at their sides;

FIG. 3 is a front plan view of a needle storage package;

FIG. 4 is a side plan view of a fragment of the base of a needle storage package showing the construction of the bifurcated projection and socket which may be used to join two or more packages together, and FIG. 5 is a side plan view showing a needle storage package being joined to two packages which have themselves been joined together.

DESCRIPTION OF THE PREFERRED EMBODIMENT

Referring to the drawings, FIG. 1 shows a preferred embodiment of a storage package for sewing machine needles. Shown at 10 is a base having a flexible hinge 12 rising therefrom. The flexible hinge 12 supports a storage sector 14 in which are formed a plurality of needle storage compartments 16. It will be appreciated from a review of FIG. 5 that the flexible hinge 12 is preferably resiliently formed to permit the storage sector 14 to be bent out of alignment with the base 10.

The storage sector 14 has preferably formed thereon first complemental interengaging means arranged along opposite side edges for connecting two needle storage packages together side-by-side. The first complemental interengaging means comprise a first and a second outturned clip 18 and an inturned tab 20. Preferably the outturned clips 18 are formed above and below the inturned tab 20. The outturned clips 18 each have a lip 22 formed at a free extremity thereof, and similarly the inturned tab 20 has a lip 24 formed at its free extremity. Preferably a second side edge of the storage sector 14 opposite that which contains the outturned clips 18 and inturned tab 20 has formed thereon a first and a second lug 19 and a reverse tab 21, with the lugs having a slot 23 to engage the lips 22 of the outturned clips 18. Similarly, the reverse tab 21 has a slot 25 adapted to receive the lip 24 of the inturned tab 20.

FIG. 2 shows that a needle storage package A may be joined to a package B by engaging the first and the second outturned clips 18 against the first and the second lugs 19 and the inturned tab 20 against the reverse tab 21 so that the lips 22 are received by the slots 23 and the lip 24 is received by the slot 25. The packages may be disengaged from each other by bending them so that the lips 22 disengage the slots 23 and the lip 24 is disengaged from the slot 25. It will be understood that any number of needle storage packages may thereby be joined side-by-side at their edges, thereby increasing the number of interconnected storage compartments 16.

FIGS. 4 and 5 best illustrate how one storage package may also be joined to another storage package by a second complemental interlocking means formed on the front and the rear surfaces of the base 10. The front of the base 10 has formed thereon a bifurcated projection 26 having an upper limb 28 and a lower limb 30. A socket 32 is formed in the rear of the base 10 and is shaped complemental to receive the bifurcated projection 26. It will be seen that due to the resiliency of the material from which the base 10 and projection 26 are constructed, when the projection 26 is pressed into the socket 32, the upper limb 28 and the lower limb 30 will be compressed until the limbs 28 and 30 of the projection 26 are fully seated within the socket 32 at which time the upper limb 28 and lower limb 30 will spread apart to occupy the space within the socket 32. One storage package may thereby be joined to another storage package front-to-back, thereby also increasing the number of storage compartments 16 available for the storage of needles. FIG. 5 shows how the flexible hinge 12 permits a storage sector 14 to be bent away from an adjacent storage sector 14, so that the needles of one package may be conveniently removed without interference with the needles of another package when the packages are joined front-to-back. It will be understood that due to the resiliency of the hinge 12 the storage sector 14 may be returned to an upright position after the removal or replacement of a needle.

Preferably a restricted aperture 34 is formed in each needle storage compartment 16 to frictionally engage the body of a sewing machine needle so that the needle will remain in the storage compartment 16 even if the needle package is turned upside down.

It will be appreciated that modifications and variations of the herein described preferred embodiment of the invention may become evident to one skilled in the art in light of the above teachings. For example, the number and size or shape of the storage compartments may be changed. It is to be understood that such variations may be made to the preferred embodiment without departing from the spirit and scope of the invention as defined in the appended claims.

I claim:

1. A needle storage package for sewing machine needles having a storage sector formed with opposite side edges; a base formed with front and rear surfaces; and a flexible hinge connecting said storage sector to said base; said storage sector having at least one storage compartment formed therein for the storage of sewing machine needles; said at least one storage compartment frictionally receiving and storing in a vertical position one sewing machine needle; first complemental interengaging means arranged along opposite side edges of each of said needle storage packages for connecting two of said needle storage packages together side by side; and second complemental interlocking means arranged on the front and rear surfaces of the base of each said needle storage packages for connecting two of said needle storage packages together front-to-back.

2. The arrangement as set forth in claim 1 wherein said first complemental interlocking means arranged on a first side edge and a second side edge comprises a first outturned clip and a second outturned clip formed on said first edge, said outturned clips each having a lip extending toward the front of said needle storage package, and an inturned tab on said first edge formed intermediate said first and said second outturned clips, said inturned tab having a lip extending toward the rear of said needle storage package; said second side edge having a first lug and a second lug formed thereon, said lugs having slots for receiving said lips of said outturned clips; and a reverse tab formed between said lugs, said reverse tab having a slot to receive said lip of said inturned tab; whereby said needle storage packages may be joined side by side along said edges by engaging said clips to said lugs and said inturned tab to said reverse tab.

3. The arrangement as set forth in claim 1 wherein said second complemental interlocking means comprises a bifurcated projection formed on the front of the base of said needle storage package and a socket for receiving said bifurcated projection formed on the rear of said base, whereby said needle storage packages may be joined front to back to each other at said bases.

4. The arrangement as set forth in claim 1 wherein said needle storage package is molded from a single piece of plastic.

* * * * *